US011016428B1

(12) United States Patent
Ishihara et al.

(10) Patent No.: US 11,016,428 B1
(45) Date of Patent: May 25, 2021

(54) IMAGE FORMING APPARATUS AND NON-TRANSITORY COMPUTER READABLE MEDIUM

(71) Applicant: FUJI XEROX CO., LTD., Tokyo (JP)

(72) Inventors: Daisuke Ishihara, Kanagawa (JP); Yuma Motegi, Kanagawa (JP); Yusuke Kaji, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/847,979

(22) Filed: Apr. 14, 2020

(30) Foreign Application Priority Data

Dec. 18, 2019 (JP) ..... JP2019-228652

(51) Int. Cl.
*G03G 15/00* (2006.01)

(52) U.S. Cl.
CPC ..... *G03G 15/5025* (2013.01); *G03G 15/5041* (2013.01); *G03G 15/5058* (2013.01)

(58) Field of Classification Search
CPC ..... G03G 15/5025; G03G 15/5041; G03G 15/5058; G03G 15/5062; G03G 2215/00569
See application file for complete search history.

(56) References Cited

U.S. PATENT DOCUMENTS

2011/0076040 A1* 3/2011 Uchidate ..... G03G 15/5058 399/49
2011/0292461 A1* 12/2011 Kubo ..... H04N 1/409 358/448
2019/0163108 A1* 5/2019 Sakurada ..... G03G 15/5041

FOREIGN PATENT DOCUMENTS

JP 2016-004117 A 1/2016

* cited by examiner

*Primary Examiner* — Sandra Brase
(74) *Attorney, Agent, or Firm* — Sughrue Mion, PLLC

(57) ABSTRACT

An image forming apparatus includes an image forming device and a setting unit. The image forming device is configured to form an image on a recording medium using a rotating body under a predetermined image forming condition. The setting unit is configured to set a correction amount for the image forming condition adjust image density unevenness corresponding to a rotation cycle of the rotating body, based on a density of the image formed by the image forming device, and cause the image forming device to form a test image to which the correction amount is applied on the recording medium.

8 Claims, 5 Drawing Sheets

IMAGE FORMING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2019-228652 filed Dec. 18, 2019.

BACKGROUND

1. Technical Field

The present disclosure relates to an image forming apparatus and a non-transitory computer readable medium.

2. Related Art

As a related art, JP-A-2016-4117 discloses that when a toner concentration of a patch image deviates from a predetermined range, again value is corrected so as to correct a developing DC voltage.

SUMMARY

In an image forming apparatus that forms an image using a rotating body such as a developing roller, an image forming condition may be corrected in order to eliminate image density unevenness corresponding to the rotation cycle of the rotating body. For example, such an image forming apparatus forms a test image to which a predetermined correction amount is applied on a recording medium, and sets an appropriate correction amount for reducing density unevenness occurring in an image based on the test image.

Aspects of non-limiting embodiments of the present disclosure relate to making it possible to efficiently set an appropriate correction amount when to correct an image forming condition to eliminate image density unevenness corresponding to the rotation cycle of a rotating body based on a test image, as compared with a case where a correction amount to be applied to the test image is constant regardless of image density.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, an image forming apparatus includes an image forming device configured to form an image on a recording medium using a rotating body under a predetermined image forming condition, and a setting unit configured to set a correction amount for the image forming condition to adjust image density unevenness corresponding to a rotation cycle of the rotating body, based on a density of the image formed by the image forming device, and cause the image forming device to form a test image to which the correction amount is applied on the recording medium.

BRIEF DESCRIPTION OF THE DRAWINGS

Exemplary embodiment(s) of the present disclosure will be described in detail based on the following figures, wherein.

DETAILED DESCRIPTION

Exemplary embodiments of the present disclosure will be described below with reference to the accompanying drawings.

Figure 1:
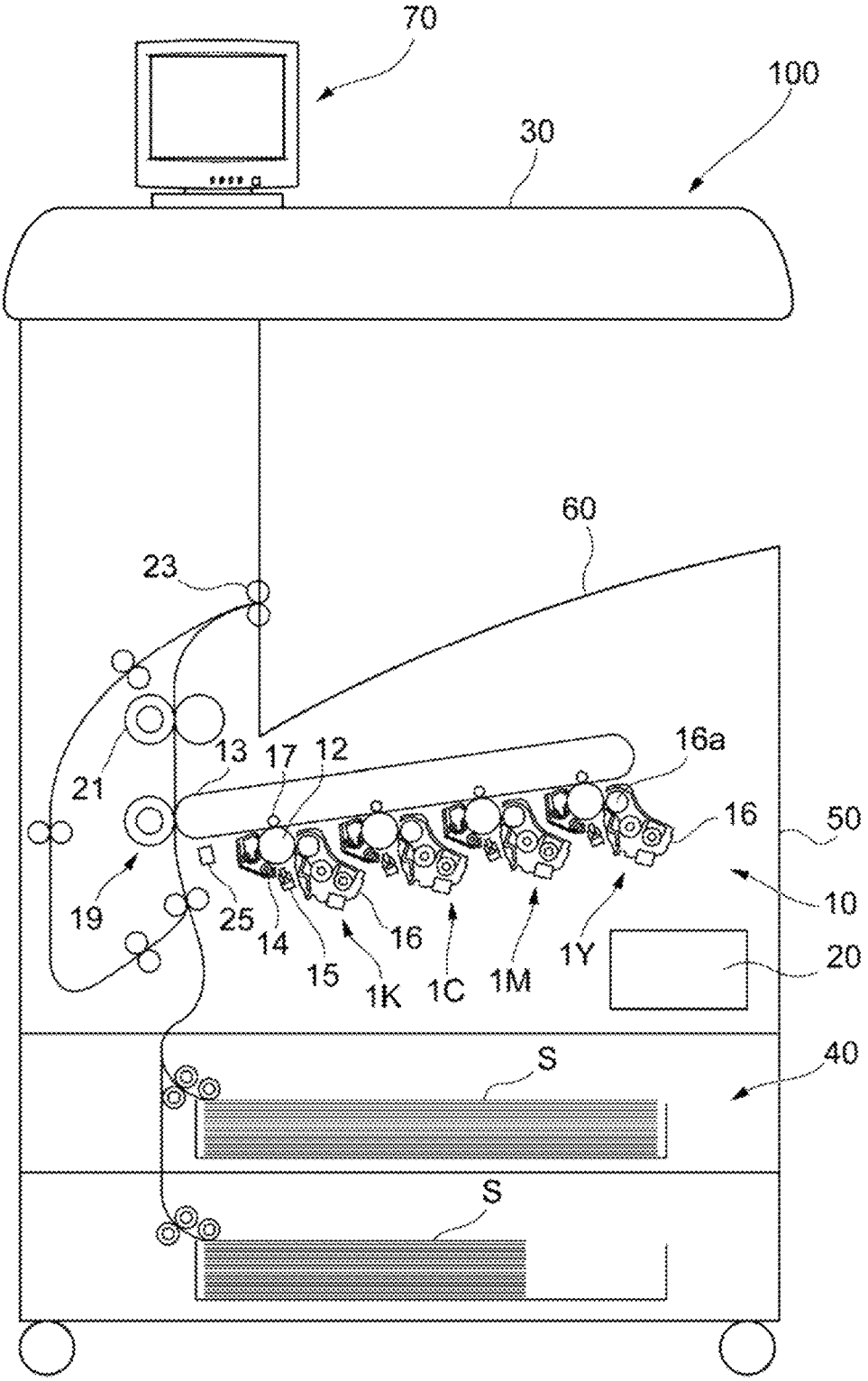
FIG. 1 is a schematic configuration diagram illustrating an image forming apparatus according to an exemplary embodiment.

FIG. 1 is a schematic configuration diagram illustrating an image forming apparatus 100 according to an exemplary embodiment. The image forming apparatus 100 illustrated in FIG. 1 is a so-called tandem color printer. The image forming apparatus 100 includes an image forming device 10, a control device 20, an image reader 30, and a sheet feeder 40. The image forming device 10 forms an image corresponding to image data of colors. The control device 20 controls the overall operation of the image forming apparatus 100. The image reader 30 reads an image of a document. The sheet feeder 40 feeds sheets S to the image forming device 10.

Here, components of the image forming apparatus 100 are accommodated in a casing 50. A stacking unit 60 is provided below the image reader 30 and on the upper surface of the casing 50. The sheet S on which the image is formed by the image forming device 10 is stacked on the stacking unit 60. An operation unit 70 is provided above the image reader 30. The operation unit 70 receives a user's operation with respect to the image forming apparatus 100.

The image forming device 10 includes four image forming units 1Y, 1M, 1C, and 1K arranged in parallel at regular intervals. The image forming units 1Y, 1M, 1C, and 1K form toner images by a so-called electrophotographic process. Here, the image forming units 1Y, 1M, 1C, and 1K are similarly configured to each other, except for toners accommodated in developing devices 16 which will be described later. The image forming units 1Y, 1M, 1C, and 1K form toner images of yellow (Y), magenta (M), cyan (C), and black (K), respectively. Therefore, in the following description, when the configurations of the image forming units 1Y, 1M, 1C, and 1K do not need to be distinguished from each other, reference signs of "Y", "M", "C", and "K" will be omitted.

The image forming device 10 includes an intermediate transfer belt 13 to which toner images of the respective colors formed on photoconductor drums 12 of the image forming units 1 are transferred. The intermediate transfer belt 13 is an example of a recording medium. The image forming device 10 includes primary transfer rollers 17 that sequentially transfer (primarily transfer) the toner images of the respective colors formed by the image forming units 1 to the intermediate transfer belt 13. The image forming device 10 includes a secondary transfer roller 19, a fixing device 21, and discharge rollers 23. The secondary transfer roller 19 collectively transfers (secondarily transfers) the toner images of the colors, which are formed on the intermediate transfer belt 13 in a superimposed manner, to a sheet S. The fixing device 21 fixes the secondarily transferred toner images of the colors onto the sheet S. The discharge rollers 23 discharge the sheet S. The image forming device 10 further includes a detector 25 that detects the toner images of the colors formed on the intermediate transfer belt 13.

The detector 25 detects a signal related to the density of the toner image formed on the intermediate transfer belt 13, and outputs the detected signal to an appropriate correction amount determination unit 207 (see FIG. 4; which will be described later) of the control device 20. The detector 25 is implemented by, for example, a photoelectric sensor that irradiates the toner image formed on the intermediate transfer belt 13 with light and receives reflected light from the toner image.

Each image forming unit 1 includes the photoconductor drum 12, a charging device 14, an exposure device 15, and a developing device 16. The photoconductor drum 12 carries a toner image. The charging device 14 charges the photoconductor drum 12. The exposure device 15 forms an electrostatic latent image by exposure of the surface of the charged photoconductor drum 12. The developing device 16 develops the electrostatic latent image formed on the photoconductor drum 12 to form the toner image.

The developing device 16 includes a rotatable developing roller 16*a* that faces the photoconductor drum 12. Each developing device 16 accommodates a developer containing a toner of a corresponding color (for example, yellow toner in the yellow image forming unit 1Y) therein. Magnets are built in the developing roller 16*a*. The developing roller 16*a* carries the developer containing the toner on the surface thereof by a magnetic force. In the developing device 16, a predetermined developing bias is applied to the developing roller 16*a* by a developing power source (not illustrated), so that the toner is transferred from the surface of the developing roller 16*a* to an image portion of the electrostatic latent image formed on the photoconductor drum 12.

The image forming apparatus 100 executes a series of image forming processing under control of the control device 20. That is, an image processor (not illustrated) performs image processing on image data acquired from a PC (not illustrated) or the image reader 30 to obtain image data of the colors, and sends the image data of each color to the exposure device 15 of the corresponding image forming unit 1. Then, the exposure device 15 performs the exposure and the developing device 16 performs the development, so that the toner image is formed on the photoconductor drum 12.

The toner images of the respective colors formed on the photoconductor drums 12 of the respective image forming units 1 are primarily transferred onto the intermediate transfer belt 13 by the respective primary transfer rollers 17 in sequence. As a result, a superimposed toner image in which the toners of the colors are superimposed is formed on the intermediate transfer belt 13. The superimposed toner image is transported toward the secondary transfer roller 19 with traveling of the intermediate transfer belt 13.

The sheet S fed from the sheet feeder 40 is transported to the secondary transfer roller 19 in accordance with a transportation timing of the superimposed toner image on the intermediate transfer belt 13. Then, the superimposed toner image on the intermediate transfer belt 13 is secondarily transferred onto the sheet S by the secondary transfer roller 19. The superimposed toner image transferred to the sheet S is fixed onto the sheet S by the fixing device 21, and then discharged to the stacking unit 60 by the discharge rollers 23.

In the image forming apparatus 100, each image forming unit 1 includes a rotating body such as the developing roller 16*a* of the developing device 16 and the photoconductor drum 12. In the image formed on the sheet S by the image forming apparatus 100, density unevenness corresponding to the rotation cycle of the rotating body may occur due to eccentricity of the rotating body or unevenness of the outer peripheral surface of the rotating body. Here, the "density unevenness corresponding to the rotation cycle of the rotating body" is a variation in image density that occurs in a sub-scanning direction of the sheet S when an image is formed on the sheet S at a uniform image density.

The image forming apparatus 100 corrects an image forming condition in order to reduce such density unevenness corresponding to the rotation cycle of the rotating body. As will be described later in detail, the image forming apparatus 100 performs predetermined correction on the image forming condition, forms a test image on the intermediate transfer belt 13, and determines an appropriate correction amount based on the test image. More specifically, the image forming apparatus 100 forms plural test images that are different in correction amount for an image forming condition, on the intermediate transfer belt 13. Then, the image forming apparatus 100 detects the plural test images which are different in correction amount by the detector 25, and determines an appropriate correction amount based on the detection results.

The test images are not particularly limited to specific ones, but may be any test images that makes a user to check the density unevenness corresponding to the rotation cycle of the rotating body. Examples of the test images include rectangular or strip-shaped images each having a length, in the sub-scanning direction, equal to or longer than a length corresponding to the rotation cycle of the rotating body.

Figure 2:
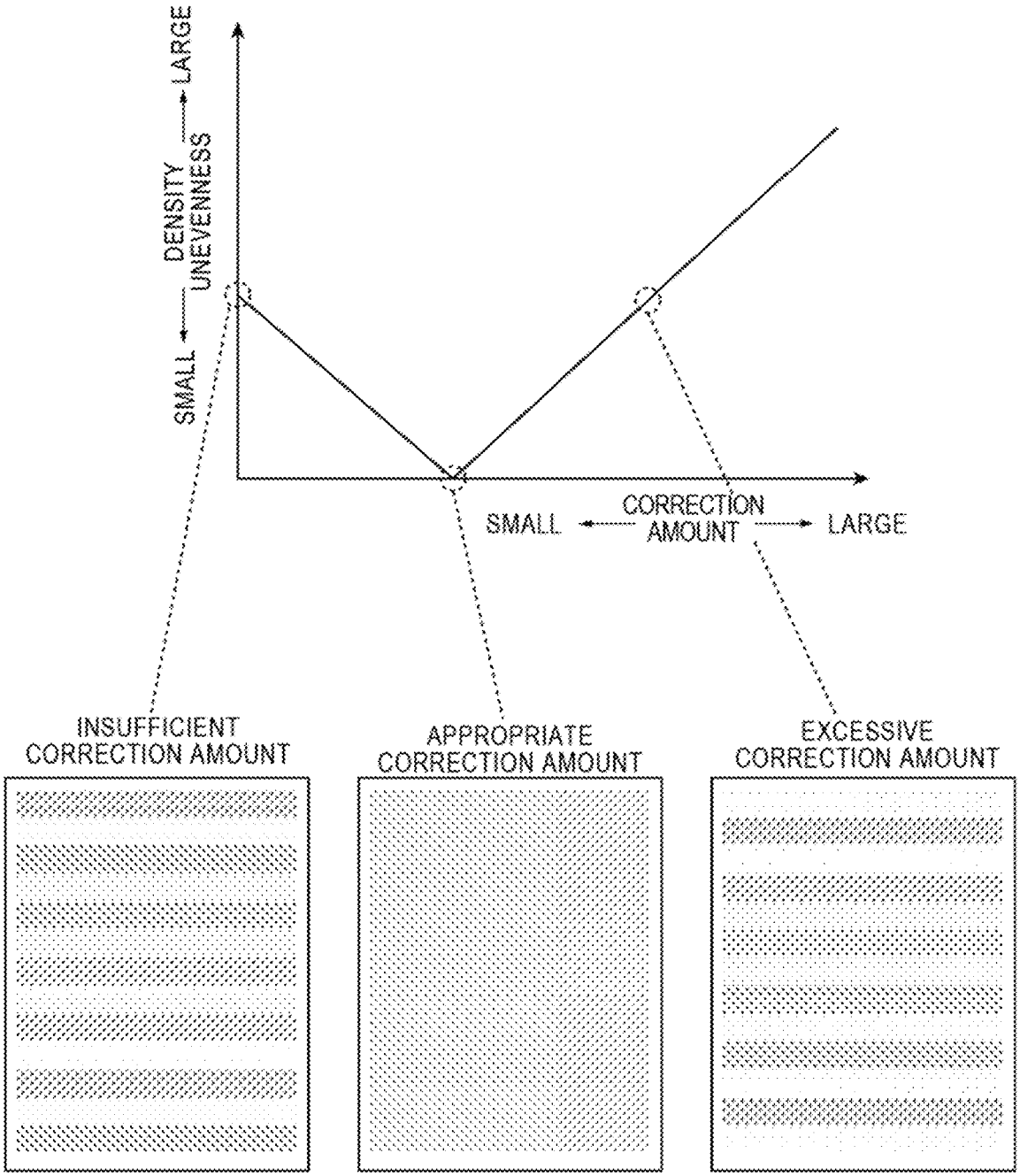
FIG. 2 is a schematic view illustrating a relationship between a magnitude of a correction amount for an image forming condition and density unevenness corresponding to the rotation cycle of a rotating body that appears in a test image.

FIG. 2 is a schematic diagram illustrating a relationship between the magnitude of the correction amount for the image forming condition and the density unevenness corresponding to the rotation cycle of the rotating body that appears in the test image.

As illustrated in FIG. 2, in the test image, a high density portion (a portion having a dark color) and a low density portion (a portion having a pale color) alternately appear in the sub-scanning direction in accordance with the rotation cycle of the rotating body. A density difference between the high density portion and the low density portion corresponds to the density unevenness corresponding to the rotation cycle of the rotating body that appears in an image. The smaller the density difference between the high density portion and the lower density portion is, the more appropriate the correction amount for the image forming condition is. In the following description, a correction amount for an image forming condition that generates the minimum density difference in a test image may be referred to as an "appropriate correction amount".

As illustrated in FIG. 2, phases of a high density portion and a low density portion that appear in a test image in accordance with the rotation cycle of the rotating body in a case where a correction amount for an image forming condition is smaller than an appropriate correction amount (that is, in a case where the correction amount is insufficient for the appropriate correction amount) are opposite to those in a case where the correction amount for the image forming condition is larger than the appropriate correction amount (that is, in a case where the correction amount is excessive for the appropriate correction amount). The control device 20 of the present exemplary embodiment determines the appropriate correction amount based on a phase relationship between the high density portion and the low density portion in such a test image and a density difference between the high density portion and the low density portion in the test image. In the following description, phases of a high density portion and a low density portion that appear in a test image in accordance with the rotation cycle of a rotating body may be referred to as a "phase of density unevenness".

When the appropriate correction amount is determined based on the plural test images which are different in correction amount for the image forming condition, the correction amounts for the image forming condition to be applied to the test images are to be close to the appropriate correction amount. That is, if values close to the appropriate correction amount are set as the correction amounts to be applied to the test images, the appropriate correction amount can be efficiently determined. On the other hand, when the appropriate correction amount deviates from a range of correction amounts to be applied to the test image or when a difference between the correction amounts to be applied to the test image and the appropriate correction amount are large, the process of forming and detecting the plural test images is to be repeated in order to determine the appropriate correction amount, which may lead to that the process of determining the appropriate correction amount is complicated.

Figure 3:
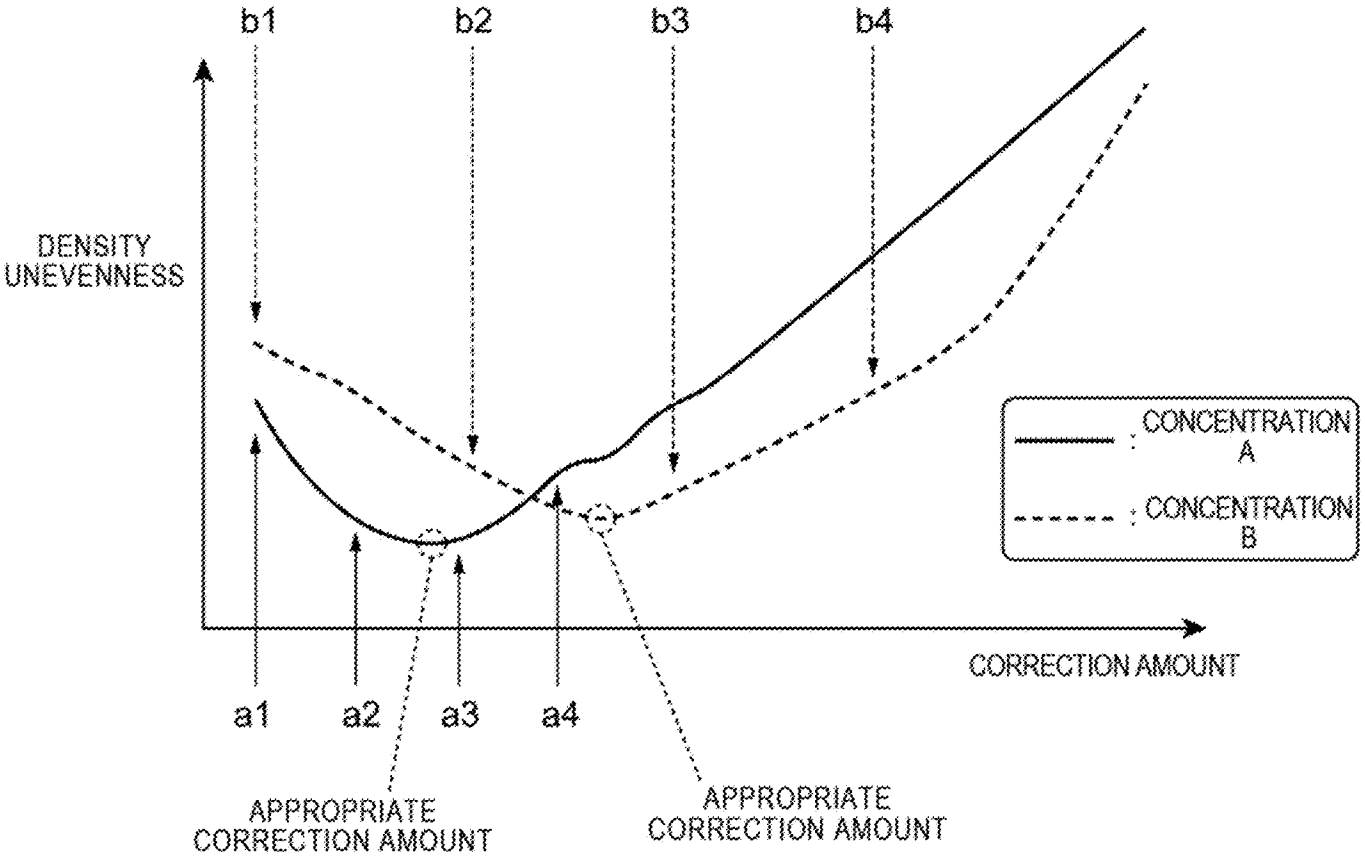
FIG. 3 is a view illustrating an example of a relationship between an correction amount for an image forming condition applied to the test image and a density difference generated in the test image.

A relationship between the correction amount for the image forming condition to be applied to the test image and the density difference generated in the test image tends to be different depending on a toner concentration when the test image is formed (hereinafter, simply referred to as the "toner concentration for the test image"). FIG. 3 is a view illustrating an example of the relationship between the correction amount for the image forming condition applied to the test image and the density difference occurring in the test image. FIG. 3 illustrates a relationship when the toner concentration for the test image is a concentration A and a relationship when the toner concentration for the test image is a concentration B larger than the concentration A.

As illustrated in FIG. 3, when the toner concentration for the test image is the concentration A, the density difference occurring in the test image more sharply changes with respect to a change of the magnitude of the correction amount than when the toner concentration for the test image is the concentration B, which is larger than the concentration A. The appropriate correction amount for the image forming condition when the toner concentration for the test image is the concentration A is smaller than that when the toner concentration for the test image is the concentration B. In addition, in the image forming apparatus 100, the smaller the toner concentration for the image formed on the intermediate transfer belt 13 is, the smaller the appropriate correction amount for the image forming condition tends to be.

Here, in the image forming apparatus 100, when a correction amount to be applied to a test image is made constant irrespective of the toner concentration for the test image, for some toner concentrations for the test image or some magnitudes of the correction amount to be applied to the test image, the appropriate correction amount may deviate from a range of correction amounts to be applied to the test image or a difference between the correction amount to be applied to the test image and the appropriate correction amount may be large. In this case, as described above, the process of determining the appropriate correction amount may be complicated.

In contrast, in the image forming apparatus 100 of the present exemplary embodiment, the correction amount to be applied to the test image is set in accordance with the toner concentration for the test image. This makes the process of determining the appropriate correction amount, efficient.

Figure 4:
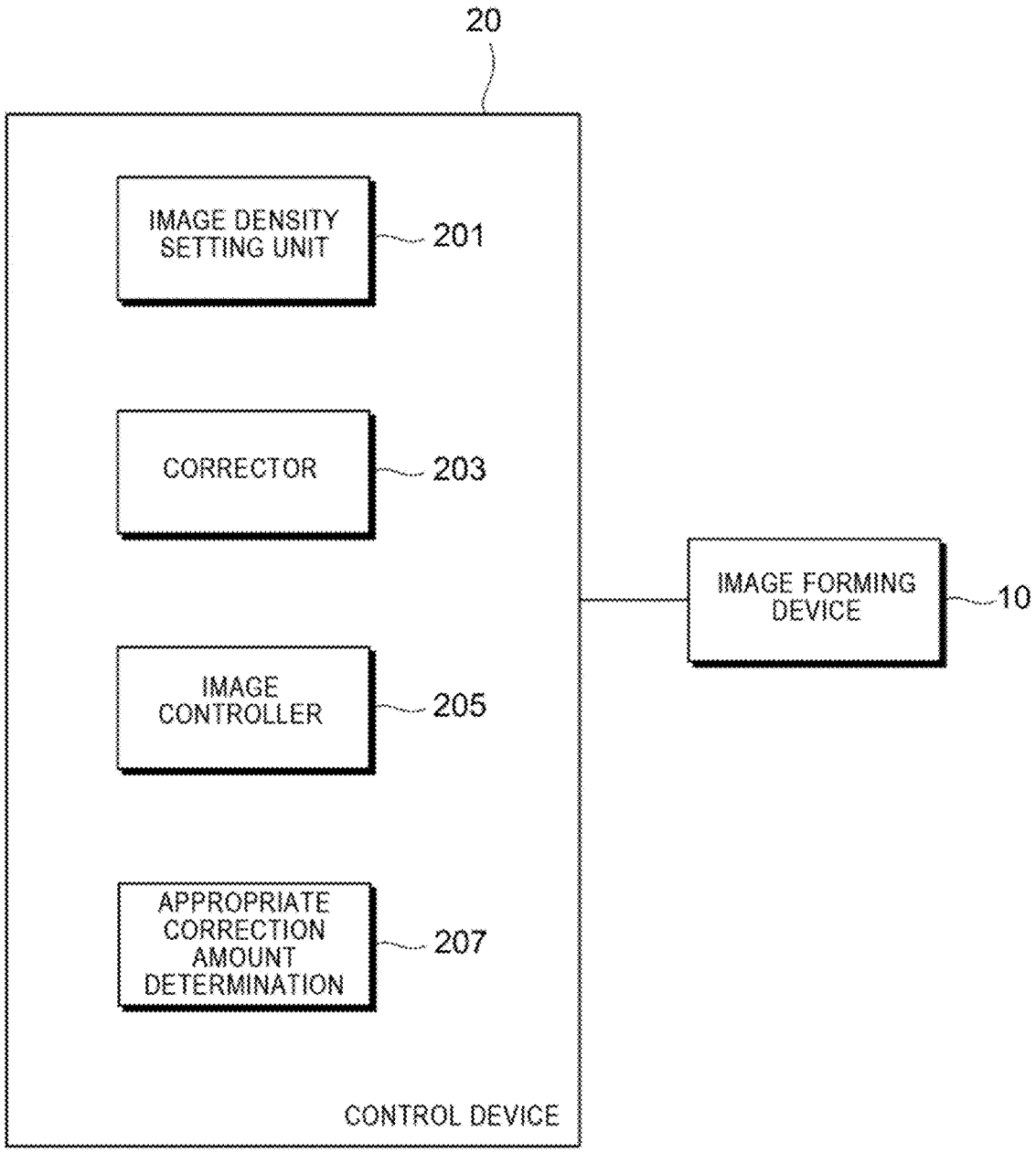
FIG. 4 is a block diagram illustrating a functional configuration of a control device according to the exemplary embodiment.

FIG. 4 is a block diagram illustrating a functional configuration of the control device 20 according to the present exemplary embodiment. Next, the control device 20 of the present exemplary embodiment will be described with reference to FIGS. 3 and 4.

As illustrated in FIG. 4, the control device 20 according to the present exemplary embodiment includes an image density setting unit 201 that sets a toner concentration for a test image. The control device 20 includes a corrector 203 and an image controller 205. The corrector 203 sets correction amounts for an image forming condition under which the image forming device 10 forms an image. The image controller 205 controls the image forming device 10 to form, on the intermediate transfer belt 13, plural test images that are different in correction amount, using (i) the toner concentration set by the image density setting unit 201 and (ii) the correction amounts for the image forming condition set by the corrector 203. The control device 20 includes the appropriate correction amount determination unit 207 that determines an appropriate correction amount based on the results of detecting the test images by the detector 25.

Here, a case where the corrector 203 sets four correction amounts and the image controller 205 forms four test images using the respective correction amounts will be described as an example.

The image density setting unit 201 sets the toner concentration for the test images based on, for example, a user's operation. Specifically, the image density setting unit 201 sets the toner concentration for the test images through a user's operation on the operation unit 70. In this example, the image density setting unit 201 receives a selection from the concentration A and the concentration B larger than the concentration A, and sets either the concentration A or the concentration B as the toner concentration for the test images.

When plural test images are formed on the intermediate transfer belt 13, the corrector 203 sets plural correction amounts to be applied to the respective test images. The corrector 203 sets the plural correction amounts to be applied to the respective test images based on the toner concentration for the test images set by the image density setting unit 201.

For example, the corrector 203 stores in advance information on a relationship between the toner concentration to be applied to the test images and the plural correction amounts to be applied to the test images, and determines the plural correction amounts to be applied to the test images based on the information.

In this example, when the image density setting unit 201 sets the concentration A as the toner concentration for the test images, the corrector 203 sets a first correction amount a1, a second correction amount a2, a third correction amount a3, and a fourth correction amount a4 ($a1<a2<a3<a4$) as the plural correction amounts to be applied to the test images. When the image density setting unit 201 sets the concentration B as the toner concentration for the test images, the corrector 203 sets a first correction amount b1, a second correction amount b2, a third correction amount b3, and a fourth correction amount b4 (b1<b2<b3<b4) as the plural correction amounts to be applied to the test images.

The first correction amount a1, the second correction amount a2, the third correction amount a3, and the fourth correction amount a4 are set at equal intervals. Similarly, the first correction amount b1, the second correction amount b2, the third correction amount b3, and the fourth correction amount b4 are set at equal intervals.

In the present exemplary embodiment, the corrector 203 sets the plural correction amounts to be applied to the test images such that the smaller the toner concentration for the test images set by the image density setting unit 201 is, the smaller the interval between the correction amounts is.

In this example, when the concentration A is set as the toner concentration for the test images, as illustrated in FIG. 3, the corrector 203 sets the first correction amount a1 to the fourth correction amount a4 such that the intervals between the first correction amount a1 to the fourth correction amount a4 are smaller than those between the first correction amount b1 to the fourth correction amount b4 which are set when the concentration B is set as the toner concentration for the test images.

When the concentration B is set as the toner concentration for the test images, as illustrated in FIG. 3, the corrector 203 sets the first correction amount b1 to the fourth correction amount b4 such that the intervals between the first correction amount b1 to the fourth correction amount b4 are larger than those between the first correction amount a1 to the fourth correction amount a4 which are set when the concentration A is set as the toner concentration for the test images.

The corrector 203 may set the correction amounts such that the smallest correction amount (in this example, the first correction amount a1 or the first correction amount b1) among the correction amounts to be applied to the test images is clearly smaller than the appropriate correction amount. When the corrector 203 sets the smallest correction amount among the correction amounts to be applied to the test images to be smaller than the appropriate correction amount, the appropriate correction amount is prevented from deviating from the range of the plural correction amounts (that is, the first correction amount a1 to the fourth correction amount a4 or the first correction amount b1 to the fourth correction amount b4) set by the corrector 203.

In the present exemplary embodiment, the corrector 203 sets the magnitude of the first correction amounts a1 and b1 to 0 (no correction), so that the first correction amounts a1 and b1 are clearly smaller than the appropriate correction amount.

The image controller 205 controls the image forming device 10 to form, on the intermediate transfer belt 13, the plural test images with toners of predetermined colors using (i) the toner concentration set by the image density setting unit 201 and (ii) the correction amounts set by the corrector 203. For example, the image controller 205 forms the plural test images side by side in the sub-scanning direction on the intermediate transfer belt 13.

The appropriate correction amount determination unit 207 determines the appropriate correction amount based on results of detecting the plural test images formed on the intermediate transfer belt 13 by the detector 25. Specifically, the appropriate correction amount determination unit 207 acquires signals about the respective test images detected by the detector 25. Next, the appropriate correction amount determination unit 207 detects the phases of the density unevenness in the respective test images and the magnitudes of density unevenness in the respective test images (that is, density differences between a high density portion and a low density portion) based on the acquired signals. Then, the appropriate correction amount determination unit 207 determines the appropriate correction amount based on the detection results.

For example, when the concentration A is set as the toner concentration for the test images in FIG. 3, the phases of the density unevenness of the test images to which the first correction amount a1 and the second correction amount a2 are applied are equal to each other. The phases of the density unevenness of the test images to which the third correction amount a3 and the fourth correction amount a4 are applied are opposite to those of the density unevenness of the test images to which the first correction amount a1 and the second correction amount a2 are applied. From this, it is estimated that the appropriate correction amount is between the second correction amount a2 and the third correction amount a3.

Also, the third correction amount a3 generates smaller density unevenness than the second correction amount a2 generates. Therefore, it is estimated that the appropriate correction amount is closer to the third correction amount a3.

The appropriate correction amount determination unit 207 determines the appropriate correction amount based on, for example, the magnitudes of the density unevenness that the second correction amount a2 and the third correction amount a3 generate. Alternatively, the appropriate correction amount determination unit 207 may set new plural correction amounts (a first correction amount a1' to a fourth correction amount a4') between the second correction amount a2 and the third correction amount a3 by the corrector 203, and cause the image controller 205 to form test images using the newly set correction amounts.

Figure 5:
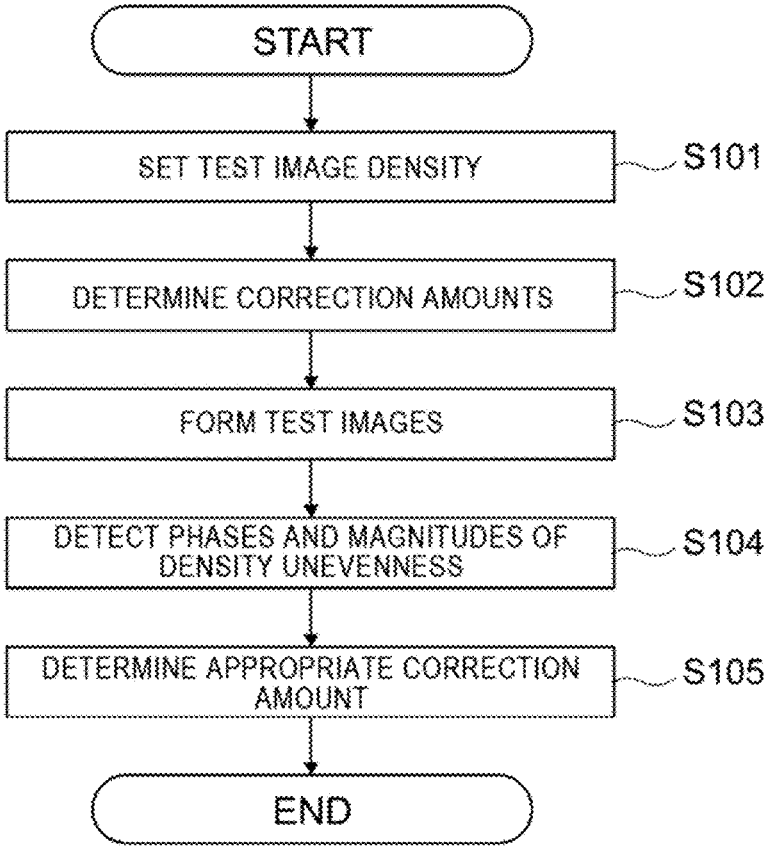
FIG. 5 is a flowchart illustrating an example of a procedure performed by the control device of the present exemplary embodiment.

Next, a procedure of determining an appropriate correction amount for an image forming condition performed by the control device 20 of the present exemplary embodiment will be described. FIG. 5 is a flowchart illustrating an example of the procedure performed by the control device 20 of the present exemplary embodiment.

In the image forming apparatus 100, when plural test images are formed to determine an appropriate correction amount for an image forming condition, the image density setting unit 201 of the control device 20 sets a toner concentration to be applied to the test images (step 101).

Next, the corrector 203 of the control device 20 sets plural correction amounts to be applied to the test images based on the toner concentration for the test images set by the image density setting unit 201 in step 101 (step 102). Here, as described above, the corrector 203 sets the plural correction amounts to be applied to the test images such that the smaller the toner concentration for the test image is, the smaller the interval between the correction amounts is.

Next, the image controller 205 of the control device 20 controls the image forming device 10 to form the plural test images on the intermediate transfer belt 13 (step 103).

In the image forming device 10, the detector 25 detects the plural test images formed on the intermediate transfer belt 13. Then, signals about the respective test images detected by the detector 25 are output to the appropriate correction amount determination unit 207 of the control device 20.

Next, based on the signals output from the detector 25, the appropriate correction amount determination unit 207 of the control device 20 detects the phase of the density unevenness in each test image and the magnitude of the density unevenness (that is, a density difference between a high density portion and a low density portion) in each test image (step 104).

Next, the appropriate correction amount determination unit 207 determines an appropriate correction amount based on (i) the detected phases of the density unevenness in the respective test images and (ii) the magnitudes of the density unevenness in the respective test images (step 105). Then, the series of processes ends.

As described above, in the image forming apparatus 100 of the present exemplary embodiment, the correction amounts for the image forming condition to be applied to the test images are set in accordance with the magnitude of the toner concentration to be applied to forming the test images. This makes it possible to efficiently determine the appropriate correction amount as compared with a case where the correction amounts to be applied to the test image are certain values regardless of the toner concentration.

In the image forming apparatus 100 of the present exemplary embodiment, the corrector 203 sets the plural correction amounts for the image forming condition and the image controller 205 forms the plural test images, which are different in correction amount. However, the present disclosure is not limited thereto. The corrector 203 may set one correction amount for the image forming condition to be applied to a test image in accordance with the magnitude of the toner concentration to be applied to forming the test image. As described above, the appropriate correction amount tends to be smaller as the toner concentration for the test images is smaller. Therefore, the corrector 203 sets a smaller correction amount for the image forming condition to be applied to the test images as the toner concentration for the test images is smaller, for example.

In the example described above, in a case of setting plural correction amounts, the corrector 203 sets the plural correction amounts such that the intervals between the correction amounts am smaller as the toner concentration for the test images is smaller. However, the present disclosure is not limited thereto. For example, the corrector 203 may change the number of correction amounts to be set in accordance with the toner concentration to be applied to the test images. For example, the corrector 203 may decrease the number of correction amounts to be set as the toner concentration for the test image decreases. In other words, the corrector 203 may increase the number of correction amounts to be set as the toner concentration for the test image increases. As described above, the appropriate correction amount tends to be larger as the toner concentration for the test image is larger. Therefore, the appropriate correction amount is prevented from deviating from the range of the correction amounts to be applied to the test images.

In the image forming apparatus 100 of the present exemplary embodiment, the appropriate correction amount is determined based on the results of detecting the test images formed on the intermediate transfer belt 13. However, the present disclosure is not limited thereto. For example, the test images may be formed on the sheet S. The sheet S is another example of the recording medium. In this case, a detector that detects a test image may be provided between a transfer position where the toner image is transferred to the sheet S by the secondary transfer roller 19 and the stacking unit 60 onto which the sheet S is discharged and stacked.

In addition, the present disclosure is not limited to the above-described exemplary embodiment. For example, the present disclosure may be applied to an intermediate transfer body of an inkjet printer. Various modifications and combinations may be made to the exemplary embodiment described above without departing from the spirit of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image forming device configured to form an image on a recording medium using a rotating body under a predetermined image forming condition; and a setting unit configured to:

set a correction amount for the image forming condition to adjust image density unevenness corresponding to a rotation cycle of the rotating body, using a density of the image formed by the image forming device;

cause the image forming device to form a test image to which the correction amount is applied on the recording medium;

set a plurality of the correction amounts that are at regular intervals, using the density; and cause the image forming device to form a plurality of the test images to which the correction amounts are applied on the recording medium, wherein the setting unit is configured to set intervals between the plurality of correction amounts to be smaller as the density is smaller.

2. The image forming apparatus according to claim 1, wherein the setting unit is configured to set at least one of the correction amounts to a correction amount that is clearly smaller than an appropriate correction amount that generates no image density unevenness.

3. The image forming apparatus according to claim 2, wherein the setting unit is configured to set at least one of the correction amounts to 0.

4. The image forming apparatus according to claim 1, further comprising:

a determination unit configured to determine an appropriate correction amount that generates no image density unevenness, using the test image to which the correction amount is applied.

5. The image forming apparatus according to claim 4, wherein the determination unit is configured to determine the appropriate correction amount using either (i) a phase of density unevenness occurring in the test image to which the correction amount is applied or (ii) a magnitude of density unevenness occurring in the test image.

6. A non-transitory computer readable medium storing a program that, if executed, causes a computer to execute image formation processing, the image forming processing comprising:

setting a correction amount for an image forming condition using a density of an image formed by an image forming device, the image forming device being configured to form the image under the image forming condition using a rotating body;

controlling the image forming device to form a test image to which the correction amount is applied on a recording medium;

setting a plurality of the correction amounts that are at regular intervals, using the density; and causing the image forming device to form a plurality of the test images to which the correction amounts are applied on the recording medium, wherein the setting the plurality of the correction amounts comprises setting intervals between the plurality of correction amounts to be smaller as the density is smaller.

7. An image forming apparatus comprising:

an image forming means for forming an image on a recording medium using a rotating body under a predetermined image forming condition; and a setting means for:

setting a correction amount for the image forming condition to adjust image density unevenness corresponding to a rotation cycle of the rotating body, using a density of the image formed by the image forming means, and causing the image forming means to form a test image to which the correction amount is applied on the recording medium setting a plurality of the correction amounts that are at regular intervals, using the density; and causing the image forming means to form a plurality of the test images to which the correction amounts are applied on the recording medium, wherein the setting the plurality of the correction amounts comprises setting intervals between the plurality of correction amounts to be smaller as the density is smaller.

8. An image forming apparatus comprising:

at least one processor configured to:

set a correction amount for an image forming condition for adjusting image density unevenness corresponding to a rotation cycle of a rotating body of an image forming device, using a density of an image formed by the image forming device on a recording medium under the image forming condition; and control the image forming device to form, on a recording medium, a test image to which the set correction amount is applied, set a plurality of the correction amounts that are at regular intervals, using the density; and control the image forming device to form a plurality of the test images to which the correction amounts are applied on the recording medium, wherein the set the plurality of the correction amounts comprises setting intervals between the plurality of correction amounts to be smaller as the density is smaller.

* * * * *